US012428204B2

(12) United States Patent
Lotfi

(10) Patent No.: US 12,428,204 B2
(45) Date of Patent: Sep. 30, 2025

(54) ENHANCED CONTENT SECURITY MECHANISMS AND RELATED CONTAINERS

(71) Applicant: Ali Lotfi, Weston, MA (US)

(72) Inventor: Ali Lotfi, Weston, MA (US)

(73) Assignee: Lacerta Group, LLC, Mansfield, MA (US)

( * ) Notice: Subject to any disclaimer, the term of this patent is extended or adjusted under 35 U.S.C. 154(b) by 37 days.

(21) Appl. No.: 16/891,009

(22) Filed: Jun. 2, 2020

(65) Prior Publication Data

US 2020/0377266 A1 Dec. 3, 2020

Related U.S. Application Data

(60) Provisional application No. 62/856,069, filed on Jun. 2, 2019.

(51) Int. Cl.
*B65D 43/16* (2006.01)

(52) U.S. Cl.
CPC ..... *B65D 43/16* (2013.01); *B65D 2251/1033* (2013.01); *B65D 2251/1041* (2013.01); *B65D 2543/00851* (2013.01)

(58) Field of Classification Search
CPC ..... B65D 81/05; B65D 85/60; B65D 2543/00851; B65D 2251/1041; B65D 2251/1033; B65D 85/322; B65D 85/307; B65D 85/30; B65D 43/16; B65D 25/108; B65D 25/10; B65D 81/02; B65D 25/105; B65D 25/103; H01L 21/67369
USPC ..... 220/513, 507, 575
See application file for complete search history.

(56) References Cited

U.S. PATENT DOCUMENTS

| | | | | |
|---|---|---|---|---|
| 5,875,896 | A * | 3/1999 | Liang | H01L 21/67366 206/593 |
| 6,082,540 | A * | 7/2000 | Krampotich | H01L 21/67369 206/711 |
| 6,988,620 | B2 * | 1/2006 | Haggard | H01L 21/67386 206/710 |
| 2009/0218254 | A1 * | 9/2009 | Andersen | H01L 21/67386 206/524.6 |
| 2013/0004625 | A1 * | 1/2013 | Brummer | B65D 81/05 53/448 |
| 2015/0028034 | A1 * | 1/2015 | Bodmer | B29C 69/02 220/826 |

* cited by examiner

*Primary Examiner* — Jeffrey R Allen
(74) *Attorney, Agent, or Firm* — JWIP & Patent Services, LLC; Jacob G. Weintraub, Esq.

(57) ABSTRACT

The present invention is directed to enhanced content security mechanisms for containers. Further, the invention is directed to containers comprising these enhanced content security mechanisms. In particular, the containers of the present invention comprising the enhanced content security mechanism of the invention offer advanced anchoring of the contents (e.g., baked goods or sensitive devices such as medical devices) of the container by preventing: shifting, tipping, breaking, crumbling, rolling or other movement of the contents; thus securing the contents and preventing damage to the contents, i.e., preserving the appearance and integrity of contents contained within.

18 Claims, 7 Drawing Sheets

ENHANCED CONTENT SECURITY MECHANISMS AND RELATED CONTAINERS

RELATED APPLICATIONS

This application claims priority to U.S. Provisional Patent Application No. 62/856,069, filed on Jun. 2, 2019; the entirety of which is incorporated herein by reference.

BACKGROUND OF THE INVENTION

Fragile or sensitive items, such as baked goods or medical devices, are particularly dependent upon packaging for protection from damage, such as damage caused by motion of the package, or even motion of the items within the package. Understandably, items like baked goods or sensitive devices damaged after packaging are far less attractive to consumers. This is especially true for decorated and ornate baked goods, including frosted cakes, pastries, muffins, or cupcakes. In this respect, a consumer is far more likely to purchase packaged baked goods in which all items remain intact and attractive; and therefore, packaging that does not protect the baked goods from damage, can have a direct negative impact on its sale or profitability.

Despite care and attention, baked goods, such as frosted or decorated baked goods, are easily damaged even while contained in protective packaging, often just by placement within the packaging. Side to side movement of cakes and cupcakes in existing packaging whether being moved within a store environment or during transit from bakery to store, or store to consumer, can cause minor to major damage, including smearing or shifting of icing and decorations. Vigorous movements may cause packaging to tip over, which in turn, may cause baked goods to tip over, to break, to crumble, to roll within the packaging, to contact other items in the packaging, or to even come in contact with the lid intended to protect the goods. This can result in the destruction of the appearance of the frostings and other decorative effects. Moreover, in existing packaging products, inversion of a package of decorated baked goods (such as when a consumer is attempting to read a label on the bottom of the package, or during transport from store to consumer) often results in smearing of frosting, icings or toppings onto the lid, negatively affecting the appearance and desirability of the baked goods.

As such, there is clearly a need for containers capable of securing items contained within the container and protecting the items from a variety of movements that may damage or reduce quality and attractiveness of the items.

SUMMARY OF THE INVENTION

Accordingly, the present invention is directed to enhanced content security mechanisms for containers. Further, the invention is directed to containers comprising these enhanced content security mechanisms. In particular, the containers of the present invention comprising the enhanced content security mechanism of the invention offer advanced anchoring of the contents (e.g., baked goods or sensitive devices such as medical devices) of the container by preventing: shifting, tipping, breaking, crumbling, rolling or other movement of the contents; thus securing the contents and preventing damage to the contents, i.e., preserving the appearance and integrity of contents contained within.

As such, one aspect of the present invention provides an enhanced content security mechanism. The mechanism comprises a pressure-activated anchor tab; and a tab-activating post, wherein the tab-activating post activates the pressure-activated anchor tab and causes the anchor tab to flex towards a content cavity when in the locked position sufficient to secure content received in the content cavity.

Another aspect of the present invention provides a container comprising an enhanced content security mechanism. The container comprises: a base portion comprising a pressure-activated anchor tab; a content cavity positioned and formed as part of the base portion capable of receiving content; and a cover portion comprising a tab-activating post, wherein the tab-activating post activates the pressure-activated anchor tab and causes the anchor tab to flex towards the content cavity when the container is in a closed and locked position sufficient to secure content received in the content cavity.

Another aspect of the present invention provides a method of improving the securing of contents within a container comprising the step of incorporating an enhanced content security mechanism of the present invention, such that the securing capability of the container is improved.

BRIEF DESCRIPTION OF THE FIGURES

Advantages of the present apparatus will be apparent from the following detailed description, which description should be considered in combination with the accompanying figures, which are not intended limit the scope of the invention in any way.

DETAILED DESCRIPTION OF THE INVENTION

Figure 1:
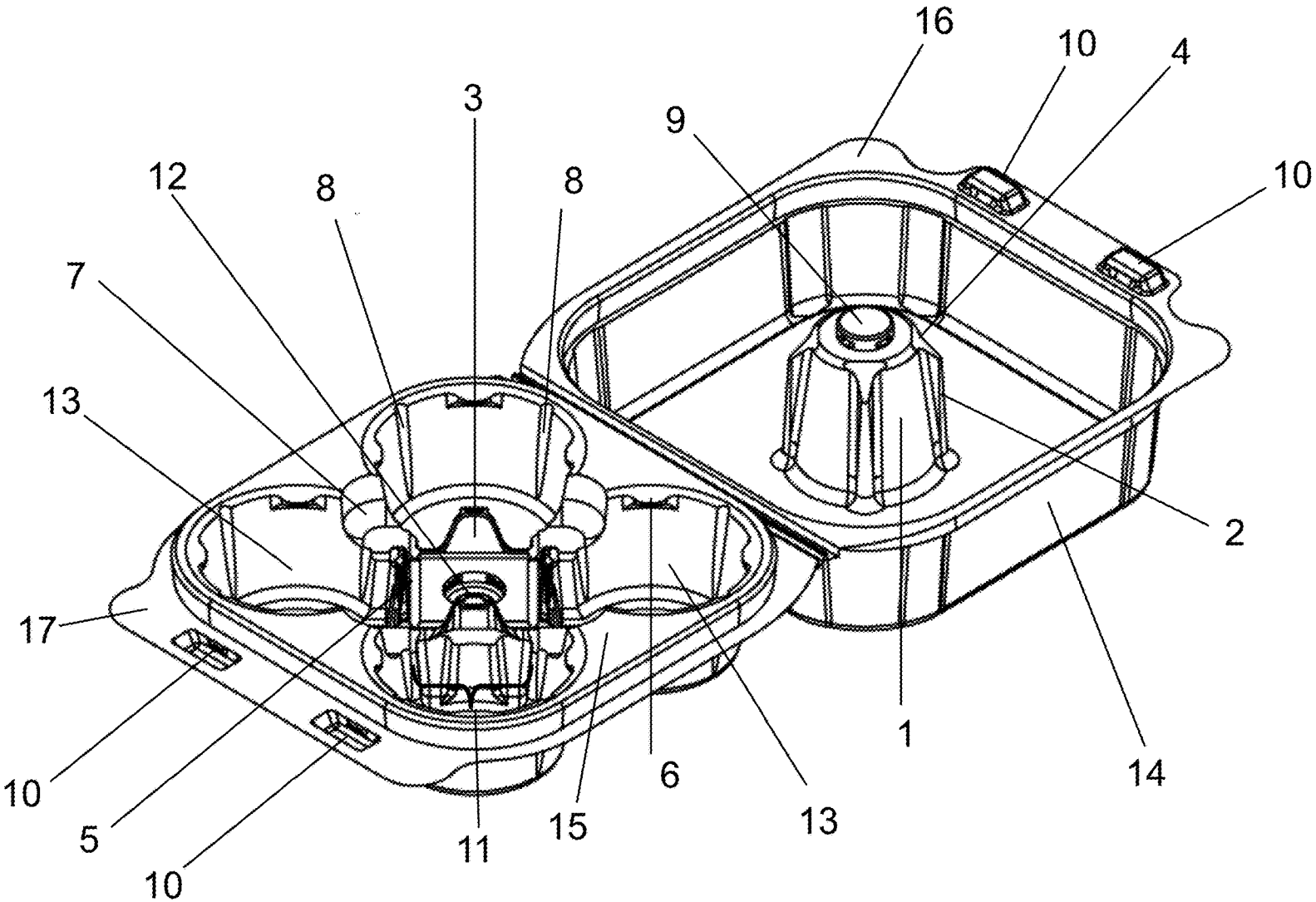
FIG. 1 depicts an angled top down perspective view of certain particular embodiments of a container of the present invention comprising an enhanced content security mechanism of the present invention, i.e., depicting the cover portion and the base portion in an open position, wherein the pressure ridge of the tab activating post is a linear column ridge.

The present invention is directed to enhanced content security mechanisms for containers. The enhanced content security mechanisms of the present invention quell movement of content in the containers by securing the content through compression of an anchor tab activated by the closure of the container. Such advancement protects the contents from damage during loading or movement within a store environment or during transit to the store, e.g., from a bakery, maintaining the attractiveness and/or integrity of the contents to the consumer. For example, with respect to the sale of baked goods, the consumer is also likely to have a greater interest in products where the baked goods are protected through container security during transportation of the goods from the place of purchase to their end destination.

The present invention is further directed to containers comprising these enhanced content security mechanisms. In particular, the containers of the present invention comprising the enhanced content security mechanism of the invention offer advanced anchoring of the contents (e.g., baked goods or sensitive devices such as medical devices) of the container by preventing: shifting, tipping, breaking, crumbling, rolling or other movement of the contents; thus securing the contents and preventing damage to the contents, i.e., preserving the appearance and integrity of contents contained within.

The present invention, including the enhanced content security mechanism, containers comprising the enhanced content security mechanism of the invention, and methods of preparation will be described with reference to the following definitions that, for convenience, are set forth below. Unless otherwise specified, the below terms used herein are defined as follows:

I. Definitions

As used herein, the term "a," "an," "the" and similar terms used in the context of the present invention (especially in the context of the claims) are to be construed to cover both the singular and plural unless otherwise indicated herein or clearly contradicted by the context.

The term "about" is used herein in reference to the degree or extent of the term which it modifies, and that such extent may be 100% or near to but not exactly 100% of the modified term; industry accepted standards will assist in defining the quantitative aspects of how "near" 100% is defined. In particular embodiments, the term "about" indicates ±3%, ±2%, ±1% or ±0.5%. In a particular embodiment, for example, the language "about 65 degrees" would be exactly 65 degrees. In an alternative particular embodiment, for example, the language "about 65 degrees" would mean 65 degrees±2%.

The terms "activate," "activating," and "activated" are used herein to describe making an item active by putting the item into motion or use. For example, in certain embodiments, the pressure-activated anchor tab of the invention is activated by the tab-activating post, e.g., when in the locked position, wherein the tab-activating post presses against the pressure-activated anchor tab of the invention, causing the pressure-activated anchor tab to move and flex along the axis of the hinged groove and to flex towards the content cavity.

The terms "audible" or "audibly" are art-recognized and are used herein to describe the feature of an item or action that is capable of being heard through the creation of a sound.

The term "baked good" is art-recognized and is used herein to describe any kind of edible food item typically prepared by baking, including, but not limited to decorated and ornate baked goods, frosted or unfrosted cakes, frosted or unfrosted pastries, frosted or unfrosted muffins, frosted or unfrosted breads, or frosted or unfrosted cupcakes, and the like.

The term "buttress" is art-recognized and is used herein to describe a structure that offers support, strength or stability against pressure, force or weight. For example, in certain embodiments, a buttress structure in the containers of the present invention form a portion of the container comprising the enhanced content security mechanism of the invention. In certain embodiments, the buttress provides structural support for the base portion of the container, e.g., positioned adjacent to the pressure-activated anchor tab, the hinged groove, the content cavity, and the internal button locking assembly, and provides strength and stability when pressure, e.g., downward pressure, is applied to the tab-activating post to lock the internal button locking assembly.

The language "close", "closed" or "closed position" describes the characterization of the container status when the cover portion and the base portion of the container are closed. For example, in certain embodiments, this would occur when the external closing assembly, i.e., a button lock positioned as a matched interlocking pair in the flange of the cover portion and base portion of the container, is closed. In another embodiment, for example, this would occur when an external closing assembly, i.e., a closing assembly associated with the rims adjacent to the flanges of the cover portion and base portion of the container (e.g., using negative draft angles or arced edge locks), is closed. In certain embodiments, the closed position is reversible, e.g., to an open position. This language is distinguished from the language "lock", "locked", or "locked position," which is the characterization of the status of the internal button locking assembly that is the result of the closure of and locking of the internal button locking assembly. For example, this would occur when the first and second internal button locking components securely interact and lock together. In certain embodiments, the locked position is reversible, e.g., to an unlocked position.

The terms "enhance" or "enhanced" are used herein to describe the improvement of a particular feature of a mechanism or container of the present invention with respect to and in comparison with known mechanisms or containers used for content security. This characterization, while qualitative in nature, may be quantified by utilizing certain measurements, such as success and failure rates in protecting from damage the contents being secured in the containers or by the mechanisms. For example, the mechanisms or containers of the present invention are characterized as enhanced if the show a measurable improvement, e.g., about 5% or greater reduction in incidence of damage to the contents being secured, e.g., about 5% or greater reduction, e.g., about 10% or greater reduction, e.g., about 20% or greater reduction, e.g., about 30% or greater reduction, e.g., about 50% or greater reduction, e.g., about 75% or greater reduction, e.g., about 90% or greater reduction, e.g., about 95% or greater reduction, e.g., about 99% or greater reduction, e.g., about 100% or greater reduction, e.g., about 150% or greater reduction.

The term "flange" is art-recognized and is used herein to describe a projecting flat rim or collar on an object, serving to strengthen an object's position on a structure upon which it rests, e.g., a lip or a rail structure. In certain embodiments of the containers of the present invention, the flange houses the external closing assembly which serves to contribute to the physical button locking components closing of the cover by interlocking the matched pair.

The terms "flex" or "flexion" are art-recognized and used herein to describe the act of flexing or bending of an object. For example, the proper positioning of a tab-activating post may cause the flexing of a pressure-activated anchor tab.

The terms "reversible" or "reversibly" are art-recognized and is used herein to describe any mechanism or action that may be utilized to repeatedly place a given item or items in one of two possible states, indefinitely. For example, a lock may be reversibly locked and unlocked multiple times; i.e., this locking or unlocking is considered reversible.

The terms "secure" and "security" are art-recognized and used herein to describe the feature or ability of an item to provide safety to or to protect a separate item (separate from the structure or item providing the security), e.g., to reduce or eliminate the risk of damage or loss of a separate item, or e.g., to anchor a separate item to reduce movement and movement-inducing damage. For example, in certain embodiments of the invention, the container comprising an enhanced content security mechanism provides increased protection and safety of the contents housed within the container, e.g., provides a reduced risk of movement of the contents, thus limiting or preventing damage or loss of the items.

II. Enhanced Content Security Mechanisms of the Invention

The present invention, including the containers and methods described herein relate to novel content security mechanisms, which not only are enhanced with respect to known content security mechanisms, but afford containers that are enhanced with respect to known containers offering content security. As such, one embodiment of the present invention provides an enhanced content security mechanism comprising:

a pressure-activated anchor tab; and a tab-activating post;

wherein the tab-activating post activates the pressure-activated anchor tab and causes the anchor tab to flex towards a content cavity when in the locked position sufficient to secure content received in the content cavity. In certain embodiments, the enhanced content security mechanism of the invention comprises a tab-activating post, an internal button locking assembly, one or more pressure-activated anchor tabs, one or more hinged grooves, and one or more buttress structures.

The utility of these identified enhanced content security mechanisms may be clearly demonstrated through incorporation into containers to achieve their intended use, and as such, another embodiment of the present invention provides containers comprising an enhanced content security mechanism. The enhanced content security mechanism is useful for, among other things, preventing shifting, tipping, breaking, crumbling, rolling, or other movement of the contents of a container. In this way, the container comprising an enhanced content security mechanism of the invention prevents damage of goods, e.g., baked goods or sensitive devices, contained therein, preserving the appearance, integrity, and attractiveness of the goods to a recipient or consumer. The ability of containers comprising an enhanced content security mechanism of the invention to better protect items, as compared to protection offered by containers lacking an enhanced content security mechanism of the invention, affords a seller, e.g., a baker or device manufacturer, and an end user, e.g., a consumer, confidence in the integrity and desirable appearance of the contents, e.g., baked goods or sensitive devices, within the container.

A. Tab-Activating Post

In certain embodiments of the present invention, the base portion further comprises one or more tab-activating posts.

In certain embodiments of the present invention, the tab-activating post extends from and forms a part of the cover portion of a container. The tab-activating post comprises a first internal button locking component, one or more pressure ridges, e.g., which may be rounded, and one or more angled anchor tab activators, e.g., which may be rounded. In certain embodiments, the tab-activating post of the enhanced content security mechanism is a tapered tab-activating post, e.g., where the tapered tab-activating post narrows in a cover to base direction, or where the tapered tab-activating post widens in a cover to base direction. In particular embodiments, the tapered tab-activating post narrows in a cover to base direction.

In certain embodiments of the present invention, the tab-activating post, e.g., a tapered tab-activating post, further comprises a first internal button locking component, e.g., a male protrusion component or a recessed female component. In particular embodiments, the first internal button locking component is a male protrusion component associated with the tab-activating post.

Figure 7:
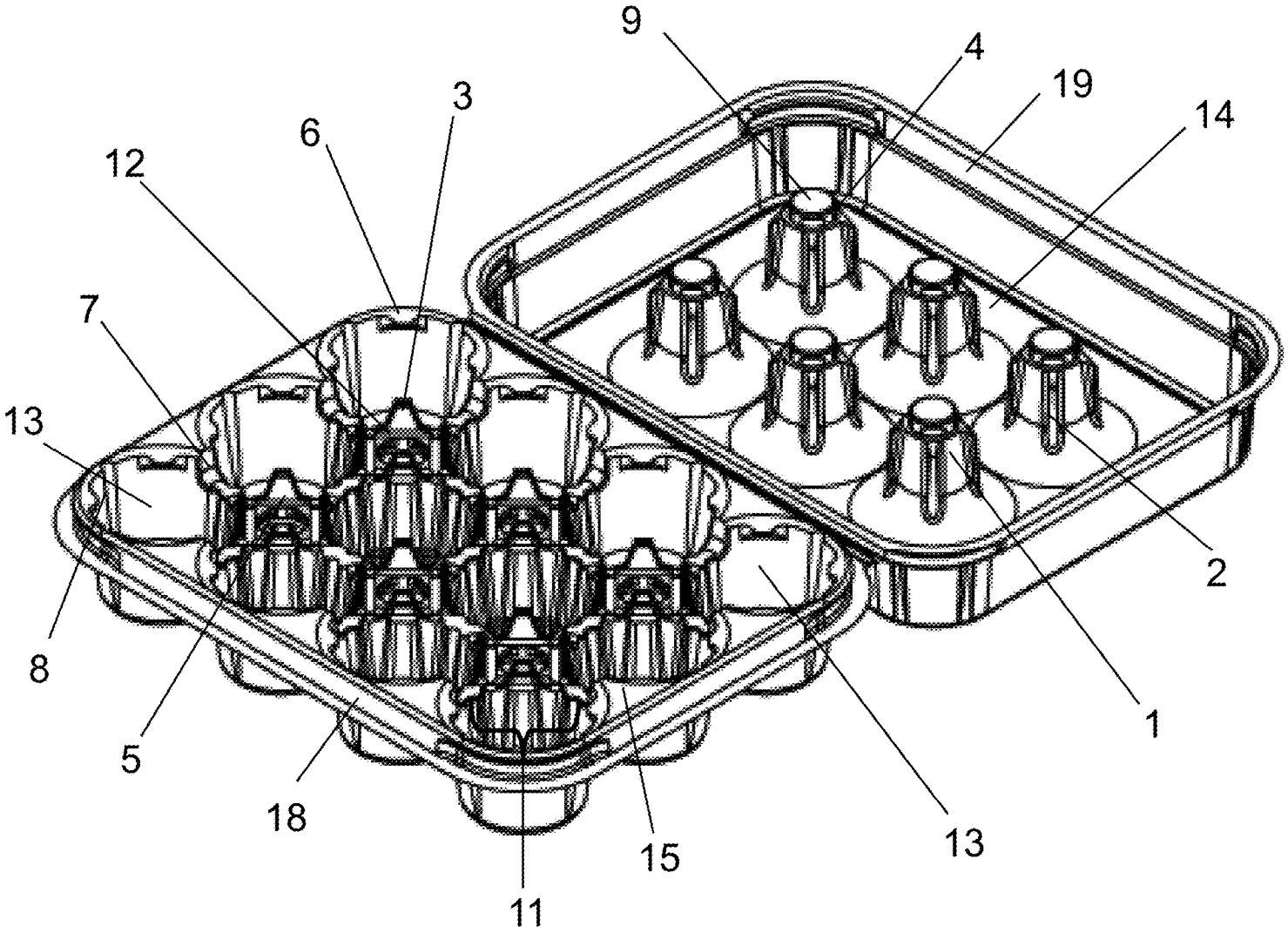
FIG. 7 depicts an angled top down perspective view of certain particular embodiments of a container of the present invention comprising multiple enhanced content security mechanisms of the present invention, i.e., depicting the cover portion and the base portion in an open position.

In certain embodiments of the present invention, the tab-activating post of the enhanced content security mechanism of the container comprises an angled anchor tab activator, where the tab activator is the portion of the tab-activating post that makes contact with the pressure-activated anchor tab to activate the pressure-activated anchor tab through the application of direct pressure; and an "angled" anchor tab activator is an anchor tab activator shaped or positioned to make contact with the pressure-activated anchor tab at or with an angled surface. In certain embodiment, the tab-activating post further comprises a pressure ridge. In particular embodiments, the angled anchor tab activator and the pressure ridge are rounded, e.g., as shown in FIG. 7.

B. Pressure-Activated Anchor Tab

In certain embodiments of the present invention, the base portion further comprises one or more pressure-activated anchor tabs, each of which provide a small projection of material suitable for anchoring the contents placed in a content cavity upon activation by applied pressure, e.g., from the tab-activating post, that may be held in a flexed position e.g., positioned to protrude towards the content cavity, e.g., towards the contents of the content cavity (e.g., contacting or touching the contents of the content cavity). In certain embodiments, the pressure-activated anchor tab may be designed to receive a shaped, e.g., rounded, pressure ridge.

In certain embodiments of the present invention, the pressure-activated anchor tab of the enhanced content security mechanism described herein is closely associated spatially with a hinged groove, e.g., a recessed hinged groove, wherein the hinge is operationally adjacent to the pressure-activated anchor tab and affords added reversible flexion through which the pressure-activated anchor tab may more easy flex towards the content cavity. In certain embodiments, the enhanced content security mechanism described herein further comprises a buttress structure for the support of the hinged groove (e.g., the recessed hinged groove), the pressure-activated anchor tab, and/or the second locking component of the internal button locking assembly. The base portion may comprise one or more buttress structures for the support of the hinged groove and anchor tab and/or a second internal button locking component.

In certain embodiments of the present invention, the flexion of the pressure-activated anchor tab occurs along the axis of the hinged groove, e.g., the recessed hinged groove.

In certain embodiments, the flexed pressure-activated anchor tab prevents contact of the contents with other contents, e.g., prevents the contact (e.g., undesired contact), of contents in one cavity with the contents of another cavity. In another embodiment, the flexed anchor tab prevents the contact, e.g., undesired contact, of the contents with the container, e.g., prevents contact of the contents with any side of the container, e.g., prevents contact of the contents with the cover of the container, or, e.g., prevents contact of the contents with the tab-activating post of the container, or any combination thereof. In certain embodiments, the flexed anchor tab prevents shifting, sliding, or moving of the contents in the content cavity C. Button Locking Assembly In certain embodiments, the tab-activing post and the pressure-activated anchor tab, may be reversibly engaged together, e.g., through locking, by a button locking assembly. As such, in certain embodiments, the containers of the present invention comprising an enhanced content security mechanism comprise a button locking assembly, e.g., an internal button locking assembly. The internal button locking assembly comprises matching button lock components on the cover and the base portions such that the container may be placed in a locked position. In certain embodiments, the cover portion comprises a first button lock component of the internal button locking assembly positioned on the tab-activating post. The base portion comprises the second button lock component of the internal button locking assembly supported by a buttress structure, which provides the locking matching pair to the first button lock component. In particular embodiments, it is the combination of the cover portion and the base portion with the internal button locking assembly in the locked position that positions the tab-activating post to activate the pressure-activated anchor tab, causing the anchor tab to flex towards the content cavity.

In certain embodiments of the present invention, the first and second locking components of the internal button locking assembly, are capable of audibly interlocking, alerting a user that the enhanced content security mechanism is locked, and that the tab-activating post has activated the pressure-activated anchor tab, causing the anchor tab to flex towards the content cavity.

In certain embodiments of the present invention, the second internal button locking component, the pressure-activated anchor tab, the hinged groove, and the buttress structure extend from and form a part of the base portion of the container. In certain embodiments, the second button lock component of the internal button locking assembly is positioned on the base portion of the container, e.g., on a portion of the base supported by a buttress structure. In certain embodiments, the second internal button locking component may be a male protrusion component or a recessed female component. In particular embodiments, the second internal button locking component is a recessed female component.

In certain embodiments of the present invention, the first and second internal button locking components of the enhanced content security mechanism are designed to securely, and reversibly, interact and lock together.

In certain embodiments of the present invention, it is the combination of the cover portion and the base portion with the internal button locking assembly of the enhanced content security mechanism in the locked position that positions the tab-activating post to activate the pressure-activated anchor tab, causing the anchor tab to flex towards the content cavity.

III. Containers Comprising the Enhanced Content Security Mechanism of the Invention The containers of the present invention comprise an enhanced content security mechanism, as described herein. As such, another embodiment of the present invention provides a container comprising an enhanced content security mechanism, wherein the container comprises:

a base portion comprising a pressure-activated anchor tab;

a content cavity positioned and formed as part of the base portion capable of receiving content; and a cover portion comprising a tab-activating post;

wherein the tab-activating post activates the pressure-activated anchor tab and causes the anchor tab to flex towards the content cavity when the container is in a closed and locked position sufficient to secure content received in the content cavity.

In certain embodiments of the present invention, the container comprising an enhanced content security mechanism described herein further comprises an internal button locking assembly. In certain embodiments, the internal button locking assembly is a snap button locking assembly. In certain embodiments, the tab-activating post, e.g., a tapered tab-activating post, extending from the cover portion comprises a first locking component of the internal button locking assembly that reversibly interlocks with a second locking component, where the base portion of the container comprises the second locking component of the internal button locking assembly. In certain embodiments, the first locking component of the internal button locking assembly is a male protrusion component. In certain embodiments, the second locking component of the internal button locking assembly is a recessed female component. In certain embodiments, the second component of the internal button locking assembly, e.g., the recessed female component, securely receives the first component of the internal button locking assembly, e.g., the male protrusion component, e.g., securely locking together the cover portion and base portion of the container, and positioning the tab-activating post to activate the pressure-activated anchor tab, causing the anchor tab to flex towards the content cavity. In particular embodiments, the first and second locking components of the internal button locking assembly, are capable of audibly interlocking, alerting a user that the enhanced content security mechanism is locked, and that the tab-activating post has activated the pressure-activated anchor tab, causing the anchor tab to flex towards the content cavity.

In certain embodiments of the present invention, the internal button locking assembly described herein is a button locking assembly where the first locking component residing on a tab-activating post, e.g., a tapered tab-activating post, is a female recessed component and the second locking component residing on the base portion of the container is a male protrusion component. In certain embodiments, the first component of the internal button locking assembly, e.g., the recessed female component, securely receives the second component of the internal button locking assembly, e.g., the male protrusion component, e.g., securely locking together the cover portion and base portion of the container, and positioning the tab-activating post to activate the pressure-activated anchor tab, causing the anchor tab to flex towards the content cavity. In particular embodiments, the first and second locking components of the internal button locking assembly, are capable of audibly interlocking, alerting a user that the enhanced content security mechanism is locked, and that the tab-activating post has activated the pressure-activated anchor tab, causing the anchor tab to flex towards the content cavity.

In certain embodiments of the present invention, the container comprising an enhanced content security mechanism described herein further comprises contents positioned in the content cavity. In certain embodiments, the contents positioned in the content cavity are sensitive devices, e.g., medical devices, which may benefit from secure packaging. In certain embodiments, the contents positioned in the content cavity are baked goods, e.g., decorated and ornate baked goods. In particular embodiments, the contents positioned in the content cavity are selected from frosted or unfrosted: cakes, pastries, muffins, breads, cupcakes, or any combination thereof.

In certain embodiments of the present invention, the one or more pressure-activated anchor tabs of the enhanced content security mechanism may be activated and held in a flexed position e.g., positioned to protrude towards the content cavity, e.g., towards the contents of the content cavity, or e.g., contacting or touching the contents of the content cavity. In certain embodiments, the flexed anchor tab prevents contact of the contents with other contents, e.g., prevents the contact (e.g., undesired contact), of contents in one cavity with the contents of another cavity. In another embodiment, the flexed anchor tab prevents the contact, e.g., undesired contact, of the contents with the container, e.g., prevents contact of the contents with any side of the container, e.g., prevents contact of the contents with the cover of the container, or, e.g., prevents contact of the contents with the tab-activating post of the container, or any combination thereof. In certain embodiments, the flexed anchor tab prevents shifting, sliding, or moving of the contents in the content cavity.

In certain embodiments of the present invention, the content cavity of the container comprising an enhanced content security mechanism described herein further comprises one or more undercut retainers, e.g., one undercut retainer, e.g., two undercut retainers, e.g., three undercut retainers, e.g., four undercut retainers, or more. In another embodiment, the content cavity comprises three undercut retainers.

In certain embodiments of the present invention, the container comprising an enhanced content security mechanism described herein further comprises one or more finger access channels, e.g., one finger access channel, e.g., two finger access channels, e.g., three finger access channels, e.g., four finger access channels, or more. In another embodiment, the container comprises four finger access channels.

In certain embodiments of the present invention, the content cavity of the container comprising an enhanced content security mechanism described herein further comprises one or more rigidity supports that, in certain embodiments, may be thermoformed ridges, channels or a combination of both that increase rigidity and strength to support the structural integrity of the container or a section of the container, e.g., one rigidity support, e.g., two rigidity supports, e.g., three rigidity supports, e.g., four rigidity supports, or more. In another embodiment, the content cavity comprises two rigidity supports.

In certain embodiments of the present invention, the container comprising an enhanced content security mechanism described herein further comprises an external closing assembly, e.g., comprising matched engagement pairs that interlock, e.g., reversibly, the cover and the base portions used to close the container.

In certain embodiments of the present invention, the container comprising an enhanced content security mechanism described herein comprises two or more content cavities, e.g., two content cavities, e.g., three content cavities, e.g., four content cavities, e.g., five content cavities, e.g., six content cavities, e.g., seven content cavities, e.g., eight content cavities, e.g., ten content cavities, e.g., twelve content cavities, e.g., fourteen content cavities, e.g., fifteen content cavities, e.g., sixteen content cavities, e.g., eighteen content cavities, e.g., twenty-four content cavities, or more. In certain embodiments, each content cavity comprises one or more rigidity supports.

In certain embodiments of the present invention, the container comprising an enhanced content security mechanism and multiple content cavities, e.g., two or more content cavities, described herein may further comprise multiple tab-activating posts, e.g., two or more tab-activating posts. For example, in certain embodiments, the container comprising an enhanced content security mechanism may comprise, e.g., six content cavities and two tab-activating posts; eight content cavities and three tab-activating posts; ten content cavities and four tab-activating posts; twelve content cavities and six tab-activating posts; fifteen content cavities and eight tab-activating posts; sixteen content cavities and nine tab-activating posts; sixteen content cavities and six tab-activating posts; eighteen content cavities and nine tab-activating posts; twenty-four content cavities and twelve tab-activating posts; or other such combinations.

In certain embodiments of the present invention, the container comprising an enhanced content security mechanism described herein comprises four content cavities and one tab-activating post.

In certain embodiments of the present invention, the tab-activating post is a storage compartment, i.e., may be used to store items in the void made by the molding of the tab-activating post. In certain embodiments, the container further comprises a lid compatible with and capable of sealing this storage compartment of the tab-activating post. In yet another embodiment, the storage compartment of the tab-activating post contains contents, e.g., decorations, e.g., sprinkles, flags, candies, frosting, icing, and the like, suitable for application to the contents of the container, e.g., baked goods, e.g., ornate baked goods, e.g., frosted cakes, e.g., pastries, e.g., muffins, e.g., bread, or e.g., cupcakes, and the like, where the lid secures the contents within the tab-activating post storage compartment.

In certain embodiments of the present invention, the cover portion and base portion of the container comprising an enhanced content security mechanism described herein are joined together by a hinge.

In certain embodiments of the present invention, the cover portion and base portion are joined to form a clamshell configuration. In certain embodiments, the clamshell may be of different shapes, e.g., rectangular, e.g., circular, e.g., square, e.g., triangular, e.g., trapezoidal, e.g., rhomboidal, and the like. In certain embodiments, the clamshell may be of different shapes representing particular objects, e.g., star-shaped, tree-shaped, flower-shaped, cupcake-shaped, egg-shaped, and the like.

In certain embodiments of the present invention, the first and second locking components of the internal button locking assembly of the container comprising an enhanced content security mechanism described herein may be reversibly locked and unlocked.

In certain embodiments of the present invention, the external closing assembly of the container comprising an enhanced content security mechanism described herein may be reversibly opened and closed.

In certain embodiments of the present invention, the present invention provides a container comprising an enhanced content security mechanism comprising:

a base portion comprising four pressure-activated anchor tabs and four hinged grooves supported by four buttress structures supporting the hinged grooves and anchor tabs, a cover portion comprising a single tab-activating post comprising four pressure ridges and four angled anchor tab activators, and four content cavities where each cavity comprises at least three undercut retainers and at least two rigidity supports, where, when the container is in a closed position, the combination of the cover portion and the base portion with the tab-activating post engages the four pressure-activated anchor tabs, causing the four anchor tabs to flex towards the four content cavities. In certain embodiments, the locking of an internal button locking assembly assists in the activation.

A. Cover Portion

The cover portion of the containers comprising an enhanced content security mechanism of the present invention, as described herein, comprises features suitable for closing, locking, and protecting the contents of the container.

In certain embodiments of the present invention, the cover portion of a container comprising an enhanced content security mechanism of the invention further comprises a tab-activating post extending from and forming a part of the cover portion. In certain embodiments, the tab-activating post is a tapered tab-activating post, where the tapered tab-activating post narrows in a cover to base direction. The tab-activating post further comprises a pressure ridge and an angled anchor tab activator, e.g., which may be rounded.

In certain embodiments of the present invention, the cover portion features a closing assembly component, e.g., an external closing assembly component, associated with a flange associated with the cover portion of the container. In certain embodiments, the flange of the cover portion of the container comprises a first external closing assembly component, e.g., a male protrusion component, or e.g., a recessed female component, designed to interact with and securely close with the matched pair component(s) residing in the base portion of the container. In certain embodiments, the closing assembly, e.g., the external closing assembly, associated with the peripheral rim adjacent to the flanges of the cover portion and base portion of the container are designed to interact with each other and securely close by reversible engagement (e.g., using negative draft angles or arced edge locks). The external closing assembly is designed to reversibly close and secure the cover to the base, thus aiding in the protection of the contents of the container.

B. Base Portion

The base portion of the container comprising an enhanced content security mechanism of the present invention serve as the lower portion of the container, i.e., the portion of the container on which the items stored in the container are placed, and with which the cover portion closes and interlocks. As such, the base portion of the containers comprising an enhanced content security mechanism of the present invention comprise features suitable for containing, closing, locking, and protecting the contents of the container.

In certain embodiments, the base portion of a container comprising an enhanced content security mechanism of the invention comprises one or more content cavities. In certain embodiments, the content cavities further comprise one or more undercut retainers. In certain embodiments, the content cavities further comprise one or more rigidity supports. In certain embodiments, the base portion further comprises one or more finger access channels, e.g., finger access channels positioned between two content cavities.

In certain embodiments of the present invention, the base portion features a closing assembly component, e.g., an external closing assembly component, associated with a flange associated with the cover portion of the container. In certain embodiments, the flange of the cover portion of the container comprises a second external closing assembly component, e.g., a male protrusion component, or e.g., a recessed female component, designed to interact with and securely close with the matched pair component(s) residing in the cover portion of the container. In certain embodiments, the closing assembly, e.g., the external closing assembly, associated with the peripheral rim adjacent to the flanges of the cover portion and base portion of the container are designed to interact with each other and securely close by reversible engagement (e.g., using negative draft angles or arced edge locks). The external closing assembly is designed to reversibly close and secure the cover to the base, thus aiding in the protection of the contents of the container.

IV. Methods of the Invention

A. Methods of Preparation

It should be readily understood by the ordinarily skilled artisan in light of the disclosure provided herein that a container constructed in accordance with the present invention can be manufactured in a variety of shapes and sizes, and can be formed from resins or plastic materials such as polyethylene, polypropylene, polyvinyl chloride or polyethyleneterephthalate ("PETE"), as well as other suitable materials or combinations thereof. Moreover, the forming process can also vary to include methods such as thermoforming, injection molding or blow molding. In certain embodiments, the container can be transparent, translucent, or opaque, and may be colored in any instance.

In certain embodiments, and by no means intended to limit the containers of the present invention in terms of design or construction, e.g., material composition, the containers comprising an enhanced content security mechanism of the present invention are prepared by using standard thermoforming techniques/technology, in conjunction with a mold constructed to produce a container comprising an enhanced content security mechanism of the present invention.

In general, thermoforming is a manufacturing process where a plastic sheet is heated to a forming-temperature as to be pliable, formed with a mold into a specific shape, and trimmed to create a usable product. The sheet is heated in an oven to a high-enough temperature that it can be stretched into or onto a mold and cooled to a finished shape. In certain embodiments, the process may be automated, for example, by using large production machines to heat and form the plastic sheet, as well as trim the formed parts from the sheet using a continuous process.

In particular embodiments, plastic sheet may be fed from a roll or from an extruder into a set of indexing chains that incorporate pins, or spikes, which pierce the sheet and transport it through an oven for heating to forming-temperature. The heated sheet then moves through another station, i.e., a form station, where, with the application of vacuum, a mold and pressure-box close on the sheet to produce the desired product, e.g., a container comprising an enhanced content security mechanism of the present invention. The sheet containing the formed product is then trimmed, e.g., with a die that cuts the product from the remaining sheet web.

In certain embodiments, the molds used in these processes may be comprised of wood, composite, or aluminum.

B. Methods of Improving the Securing of Contents Within a Container

Another embodiment of the present invention provides a method of improving the securing of contents within a container comprising the step of incorporating an enhanced content security mechanism of the present invention into a container, such that the securing capabilities of the container is enhanced or improved. In a particular embodiment of the present invention, the present invention provides a method of improving the securing of contents within a container comprising the step of incorporating an enhanced content security mechanism comprising a pressure-activated anchor tab and a tab-activating post into a container, such that the securing capability of the container is improved.

V. Design Aspects of the Invention

Independent of the utility related to the containers of the present invention, the ornamental appearance of any novel design provided herein is intended to be part of this invention, for example, each of the perspective views in FIGS. 1 through 7, which may form an independent or combined ornamental appearance of the containers described herein.

Accordingly, one embodiment of the present invention provides an ornamental design for a container comprising an enhanced content security mechanism of the present invention as shown and described.

Exemplification

Having thus described the invention in general terms, reference will now be made to the accompanying drawings of exemplary embodiments, which are not necessarily drawn to scale, and which are not intended to be limiting in any way.

In this respect, it is to be understood that the invention is not limited in its application to the details of construction and to the arrangements of the components set forth in the description provided herein or illustrated in the Figures. The invention is capable of other embodiments and of being practiced and carried out in various ways. Also, it is to be understood that the phraseology and terminology employed herein are for the purpose of description and should not be regarded as limiting.

FIG. 1 depicts an angled top down perspective view of certain particular embodiments of a container of the present invention comprising an enhanced content security mechanism of the present invention, i.e., depicting the cover portion 14 and the base portion 15 in an open position, wherein the pressure ridge of the tab activating post is a linear column ridge. In particular, the cover portion 14 of a container comprising an enhanced content security mechanism of the invention depicts a tab activating post 1 extending from and forming a part of the cover portion 14. In this embodiment, the tab activating post 1 is a tapered tab activating post 1, where the tapered tab activating post 1 narrows in a cover to base direction. The tab activating post 1 further comprises a pressure ridge 2 and an angled anchor tab activator 4. The tab activating post 1 further comprises a first internal button locking component 9, i.e., associated with tab activating post 1. In this embodiment, the first internal button locking component 9 is a male protrusion component.

In particular, the base portion 15 of the container comprising an enhanced content security mechanism of the invention comprises a content cavity 13. The content cavity 13 further comprises an undercut retainer 6 and a rigidity support 8. The base portion 15 further comprises a finger access channel 7. In this embodiment, the finger access channel 7 is positioned between two content cavities. The base portion 15 further comprises a pressure activated anchor tab 3 closely associated with a hinged groove 5. In this embodiment, the hinged groove 5 is a recessed hinge groove. The base portion 15 further comprises a buttress structure 11 for supporting the hinge groove 5, and anchor tab 3. The base portion 15 further comprises a second internal button locking component 12, i.e., associated with, e.g., supported by, a buttress structure 11. In this embodiment, the second internal button locking component 12 is a recessed female component.

In certain embodiments, the first and second components of the internal button locking components are designed to audibly, securely, and reversibly interact and lock together.

The container comprising an enhanced content security mechanism of the present invention may further comprise a closing mechanism, i.e., an external closing assembly 10, i.e., associated with flange 16 that is associated with the cover portion 14 or flange 17 that is associated with the base portion 15 of the container. In certain embodiments, the flange 16 of the cover portion 14 of the container comprises a first external closing assembly 10 and the flange 17 of the base portion 15 of the container comprises a second external closing assembly 10. In certain embodiments, the first external closing assembly 10 residing on the flange 16 of the cover portion 14 is a male protrusion component and the second external closing assembly 10 residing on the flange 17 of the base portion 15 is a recessed female component.

In certain embodiments, the first and second components of the external closing assembly are designed to securely and reversibly interact and associate together to close the container.

Figure 2:
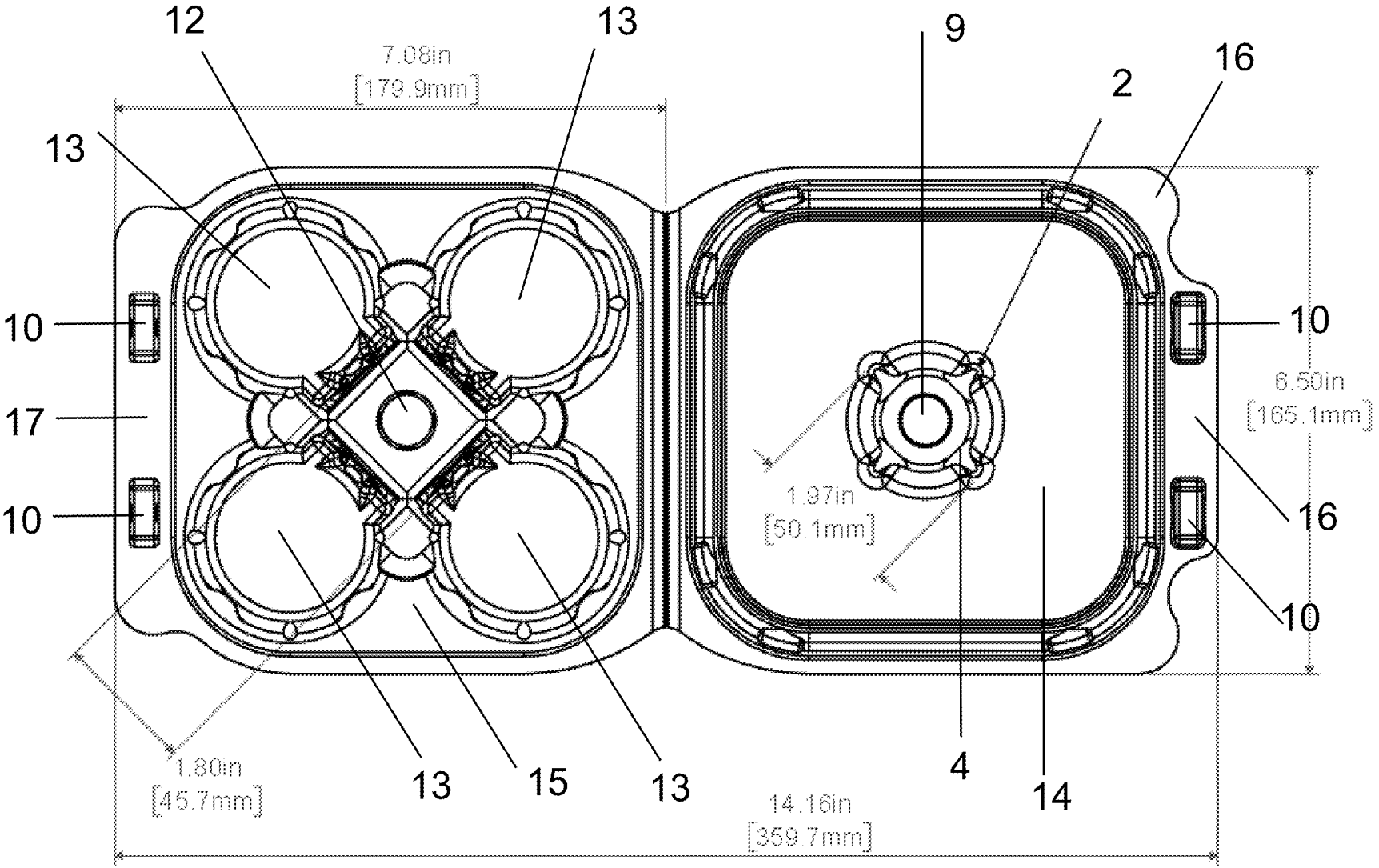
FIG. 2 depicts a top down perspective view of certain particular embodiments of a container of the present invention comprising an enhanced content security mechanism of the present invention, i.e., depicting the cover portion and the base portion in an open position, further indicating specific dimensions of various aspects of the container.

FIG. 2 depicts a top down perspective view of certain particular embodiments of a container of the present invention comprising an enhanced content security mechanism of the present invention, i.e., depicting the cover portion 14 and the base portion 15 in an open position, further indicating specific dimensions of various aspects of the container, including a front-to-back length of 7.08 inches and a side-to-side width of 6.50 inches, giving a total open length of 14.16 inches. In particular, the cover portion 14 of a container comprising an enhanced content security mechanism of the invention, i.e., including a tab activating post comprising a pressure ridge 2, an angled anchor tab activator 4, and a first internal button locking component 9. In this embodiment, the first internal button locking component 9 is a male protrusion component. The base portion 15 of a container comprises a content cavity 13 (e.g., with a diameter of 1.80 inches), and a second internal button locking component 12. In this embodiment, the second internal button locking component 12 is a recessed female component.

In certain embodiments, the first and second internal button locking components are designed to audibly, securely, and reversibly interact and lock together.

The container comprising an enhanced content security mechanism of the present invention further comprises a closing mechanism, i.e., an external closing assembly 10, i.e., associated with flange 16 that is associated with the cover portion 14 or flange 17 that is associated with the base portion 15 of the container. In this embodiment, the flange 16 of the cover portion 14 of the container comprises a first external closing assembly 10 and the flange 17 of the base portion 15 of the container comprises a second external closing assembly 10. In this embodiment, the first external closing assembly 10 residing on the flange 16 of the cover portion 14 is a male protrusion component and the second external closing assembly 10 residing on the flange 17 of the base portion 15 is a recessed female component.

In certain embodiments, the first and second external closing assembly are designed to securely and reversibly interact and associate together to close the container.

Figure 3:
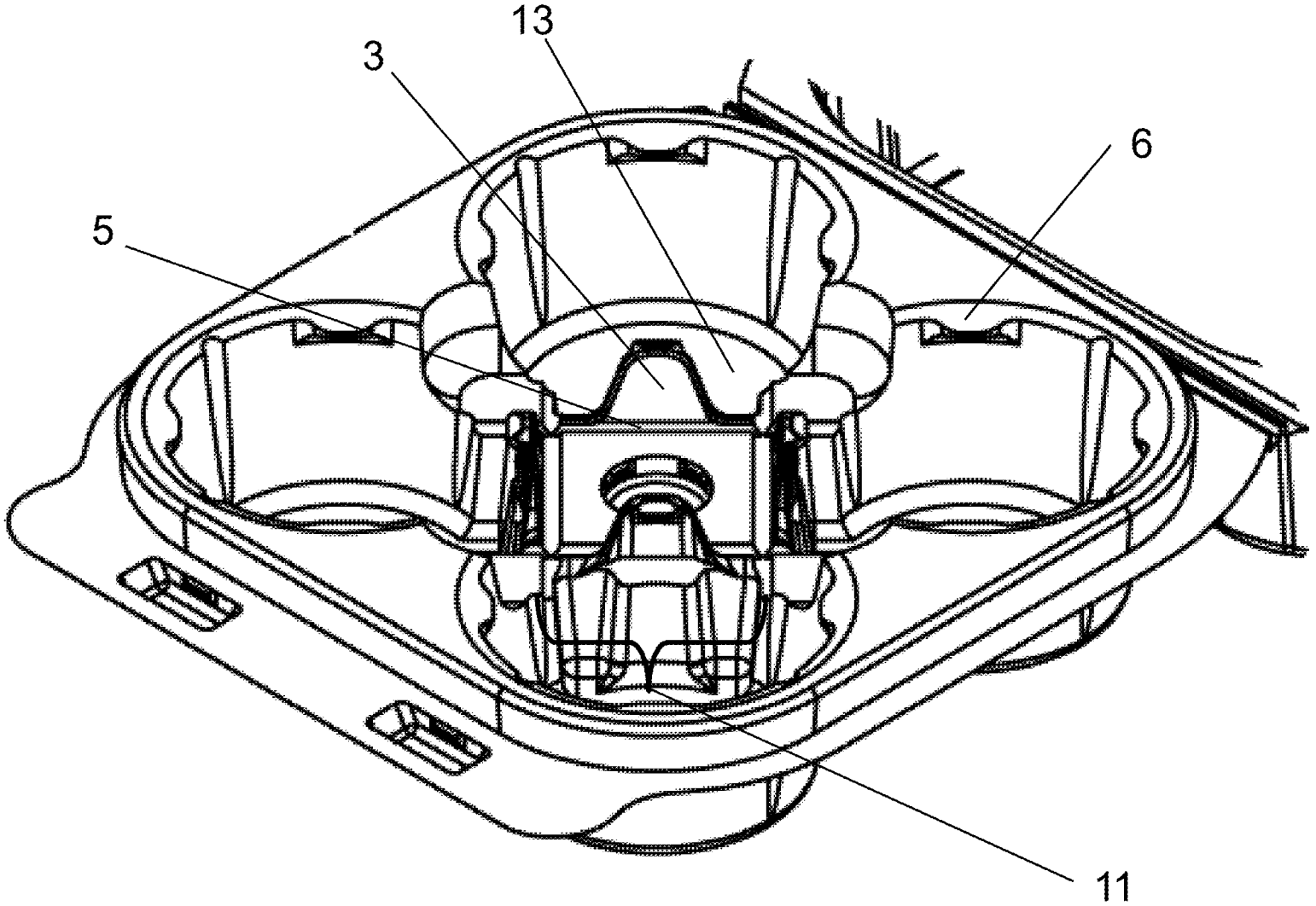
FIG. 3 depicts an angled top down perspective view of certain particular embodiments of a container of the present invention comprising an enhanced content security mechanism of the present invention, i.e., depicting the base portion in an open position.

FIG. 3 depicts an angled top down perspective view of certain particular embodiments of a container of the present invention comprising an enhanced content security mechanism of the present invention, i.e., the base portion 15 in an open position. In particular, the base portion 15 of a container comprising an enhanced content security mechanism of the invention comprises a content cavity 13. The content cavity 13 further comprises an undercut retainer 6, and a pressure activated anchor tab 3 closely associated with a hinged groove 5. In this embodiment, the hinged groove 5 is a recessed hinged groove. The base portion 15 further comprises a buttress structure 11 for the support of the hinged groove 5 and anchor tab 3.

Figure 4:
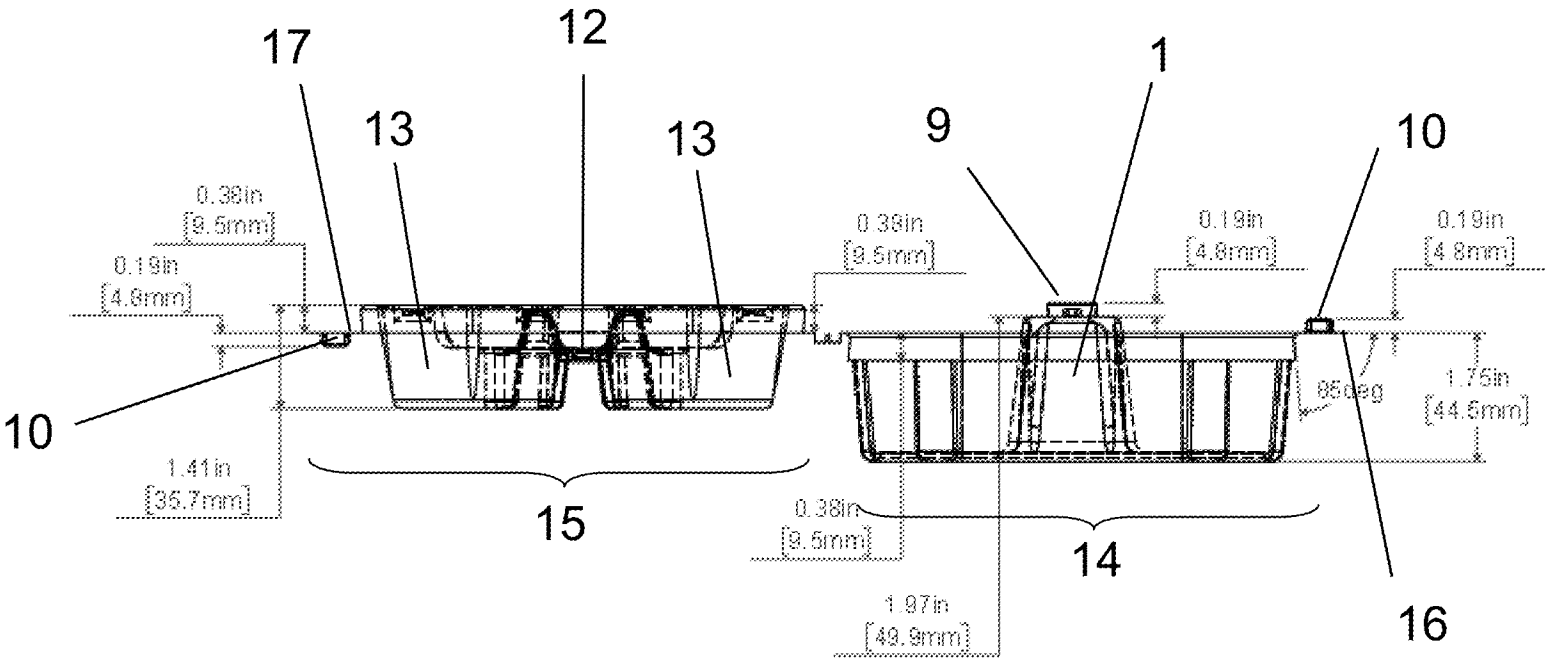
FIG. 4 depicts a side-view perspective view of certain particular embodiments of a container of the present invention comprising an enhanced content security mechanism of the present invention, i.e., depicting the cover portion and the base portion in an open position, further indicating specific dimensions of various aspects of the container.

FIG. 4 depicts a side-view perspective view of certain particular embodiments of a container of the present invention comprising an enhanced content security mechanism of the present invention, i.e., depicting the cover portion 14 and the base portion 15 in an open position, further indicating specific dimensions of various aspects of the container, including the height of the cover portion 14 as 1.75 inches with the tab-activating post 1 extending 0.22 inch beyond this height, and the base portion 15 as 1.41 inches. In particular, the cover portion 14 of a container comprising an enhanced content security mechanism of the invention depicts a tab activating post 1 extending from and forming a part of the cover portion 14. In certain embodiments, the tab activating post 1 is a tapered tab activating post 1, where the tapered tab activating post 1 narrows in a cover to base direction. The tab activating post 1 further comprises a first internal button locking component 9, i.e., associated with a tab activating post 1. In certain embodiments, the first internal button locking component 9 is a male protrusion component, e.g., with a button height of 0.19 inch. The base portion 15 of the container comprises a content cavity 13. The base portion 15 further comprises a second internal button locking component 12 to match pair with the first internal button locking component. In this embodiment, the second internal button locking component 12 is a recessed female component.

The container comprising an enhanced content security mechanism of the present invention may further comprise a closing mechanism, i.e., an external closing assembly 10, i.e., associated with flange 16 that is associated with the cover portion 14 or flange 17 that is associated with the base portion 15 of the container. In certain embodiments, the flange 16 of the cover portion 14 of the container comprises a first external closing assembly 10 and the flange 17 of the base portion 15 of the container comprises a second external closing assembly 10. In certain embodiments, the first external closing assembly 10 residing on the flange 16 of the cover portion 14 is a male protrusion component, e.g., with a protrusion height of 0.19 inch, and the second external closing assembly 10 residing on the flange 17 of the base portion 15 is a recessed female component, e.g., with a recession depth of 0.19 inch.

FIG. 4 shows the angle between the rim exterior (0.38 inch) and the flange 16 is about 85 degrees.

In certain embodiments, the first and second external closing assembly components are designed to securely and reversibly interact and associate together to close the container.

Figure 5:
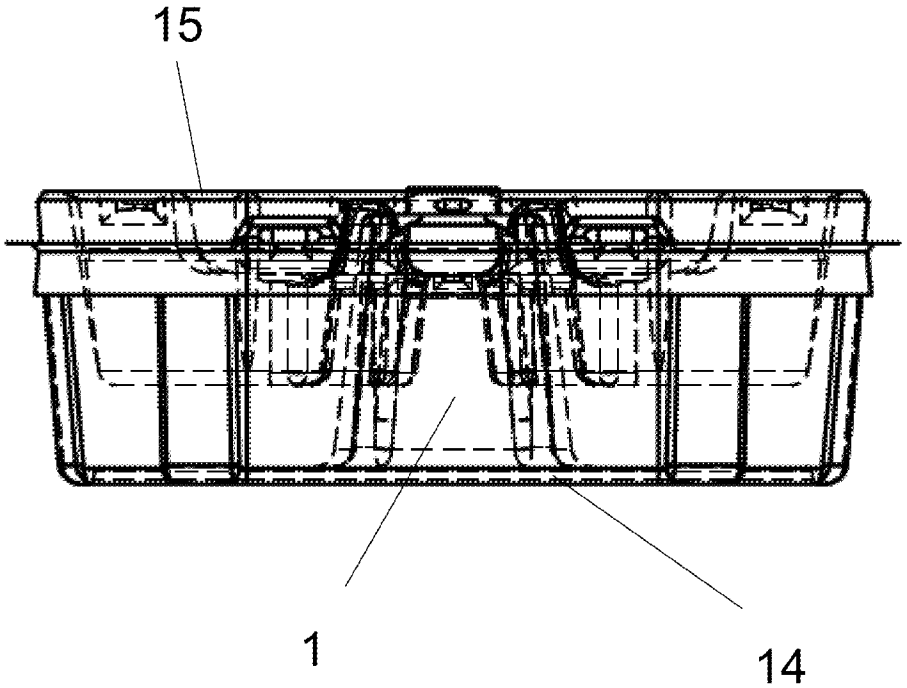
FIG. 5 depicts a side-view perspective view of certain particular embodiments of a container of the present invention comprising an enhanced content security mechanism of the present invention, i.e., depicting the cover portion and the base portion in a closed position.

FIG. 5 depicts a side-view perspective view of certain particular embodiments of a container of the present invention comprising an enhanced content security mechanism of the present invention, i.e., depicting the cover portion 14 and the base portion 15 in a closed position. In particular, the cover portion 14 of a container comprising an enhanced content security mechanism of the invention depicts a tab activating post 1 extending from and forming a part of the cover portion 14, where the tab activating post engages the pressure-activated anchor tab, e.g., through internal button locking. In this embodiment, the tab activating post 1 is a tapered tab activating post 1, where the tapered tab activating post 1 narrows in a cover to base direction.

Figure 6:
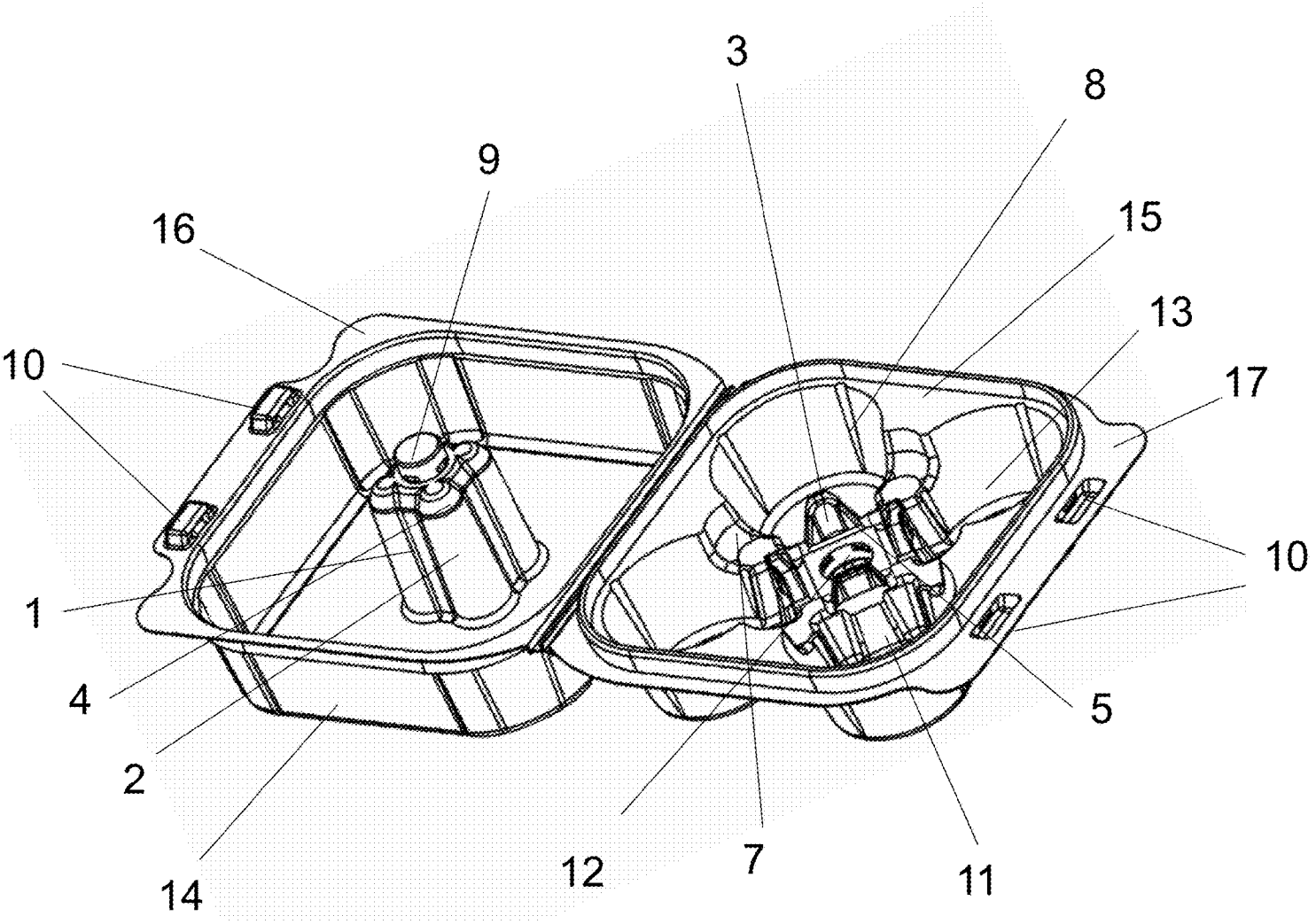
FIG. 6 depicts an angled top down perspective view of certain particular embodiments of a container of the present invention comprising an enhanced content security mechanism of the present invention, i.e., depicting the cover portion and the base portion in an open position, wherein the pressure ridge of the tab activating post is rounded.

FIG. 6 depicts an angled top down perspective view of certain particular embodiments of a container of the present invention comprising an enhanced content security mechanism of the present invention, i.e., depicting the cover portion 14 and the base portion 15 in an open position, wherein the pressure ridge 2 of the tab activating post 1 is rounded. In particular, the cover portion 14 of a container comprising an enhanced content security mechanism of the invention depicts a tab activating post 1 extending from and forming a part of the cover portion 14. In this embodiment, the tab activating post 1 is a tapered tab activating post 1, where the tapered tab activating post 1 narrows in a cover to base direction. The tab activating post 1 further comprises a rounded pressure ridge 2 and a rounded angled anchor tab activator 4. The tab activating post 1 further comprises a first internal button locking component 9, i.e., associated with tab activating post 1. In this embodiment, the first internal button locking component 9 is a male protrusion component.

In particular, the base portion 15 of the container comprising an enhanced content security mechanism of the invention comprises a content cavity 13. The content cavity 13 further comprises a rigidity support 8. The base portion 15 further comprises a finger access channel 7. In this embodiment, the finger access channel 7 is positioned between two content cavities. The base portion 15 further comprises a pressure activated anchor tab 3 closely associated with a hinged groove 5. The pressure activated anchor tab 3 may be designed to receive a shaped, e.g., rounded, pressure ridge. In this embodiment, the hinged groove 5 is a recessed hinge groove. The base portion 15 further comprises a buttress structure 11 for supporting the hinge groove 5, and anchor tab 3. The base portion 15 further comprises a second internal button locking component 12, i.e., associated with, e.g., supported by, a buttress structure 11. In this embodiment, the second internal button locking component 12 is a recessed female component.

In certain embodiments, the first and second components of the internal button locking components are designed to audibly, securely, and reversibly interact and lock together.

The container comprising an enhanced content security mechanism of the present invention may further comprise a closing mechanism, i.e., an external closing assembly 10, i.e., associated with flange 16 that is associated with the cover portion 14 or flange 17 that is associated with the base portion 15 of the container. In certain embodiments, the flange 16 of the cover portion 14 of the container comprises a first external closing assembly 10 and the flange 17 of the base portion 15 of the container comprises a second external closing assembly 10. In certain embodiments, the first external closing assembly 10 residing on the flange 16 of the cover portion 14 is a male protrusion component and the second external closing assembly 10 residing on the flange 17 of the base portion 15 is a recessed female component.

In certain embodiments, the first and second components of the external closing assembly are designed to securely and reversibly interact and associate together to close the container.

FIG. 7 depicts an angled top down perspective view of certain particular embodiments of a container of the present invention comprising multiple enhanced content security mechanisms of the present invention, i.e., the cover portion 14 and the base portion 15 in an open position. In particular, the cover portion 14 of a container comprising an enhanced content security mechanism of the invention depicts six tab activating posts 1 extending from and forming a part of the cover portion 14. In the embodiment, the tab activating posts 1 are tapered tab activating posts 1, where the tapered tab activating posts 1 narrow in a cover to base direction. The tab activating posts 1 further comprise pressure ridges 2 and angled anchor tab activators 4. Each tab activating post 1 further comprises a first internal button locking component 9, i.e., associated with a tab activating post 1. In this embodiment, the first internal button locking components 9 are male protrusion components.

In particular, the base portion 15 of the container comprising an enhanced content security mechanism of the invention comprises twelve content cavities 13. The content cavities 13 further comprise undercut retainers 6 and rigidity supports 8. The base portion 15 further comprises finger access channels 7. In this embodiment, the finger access channels 7 are positioned between two content cavities. The base portion 15 further comprises pressure activated anchor tabs 3 closely associated with hinged grooves 5. In this embodiment, the hinged grooves 5 are recessed hinge grooves. The base portion 15 further comprises twenty four buttress structures 11 for the support of the hinge grooves 5 and anchor tabs 3. The base portion 15 further comprises six second internal button locking components 12, each associated with four buttress structures 11. In this embodiment, the second internal button locking components 12 are recessed female components.

In certain embodiments, the first and second internal button locking components are designed to audibly, securely, and reversibly interact and lock together.

The container comprising an enhanced content security mechanism of the present invention may further comprise a closing mechanism, i.e., a closing assembly associated with the rim 19 adjacent to the flange of the cover portion and the rim 18 adjacent to the flange of the base portion of the container (e.g., using negative draft angles or arced edge locks). In certain embodiments, the rim 19 and the rim 18 of the container comprise an external rim closing assembly, e.g., designed to securely and reversibly close.

INCORPORATION BY REFERENCE

The entire contents of all patents, published patent applications and other references cited herein are hereby expressly incorporated herein in their entireties by reference.

EQUIVALENTS

Those skilled in the art will recognize, or be able to ascertain using no more than routine experimentation, numerous equivalents to the specific procedures described herein. Such equivalents were considered to be within the scope of this invention and are covered by the following claims. Moreover, any numerical or alphabetical ranges provided herein are intended to include both the upper and lower value of those ranges. In addition, any listing or grouping is intended, at least in certain embodiments, to represent a shorthand or convenient manner of listing independent embodiments; as such, each member of the list should be considered a separate embodiment.

What is claimed is:

1. A container comprising an enhanced content security mechanism, wherein the container comprises:

a base portion comprising an outer perimeter and a pressure-activated anchor tab, wherein the pressure-activated anchor tab provides a small projection of material suitable for anchoring contents placed in a content cavity upon activation by applied pressure, and which may be held in a flexed position to protrude towards the content cavity;

the content cavity positioned and formed as part of the base portion within the outer perimeter and capable of receiving content; and a cover portion comprising a tab-activating post, wherein the tab-activating post extends from and forms a part of the cover portion in a cover portion to base portion direction and makes contact with the pressure-activated anchor tab to activate the pressure-activated anchor tab through the application of direct pressure, wherein the tab-activating post activates the pressure-activated anchor tab and causes the pressure-activated anchor tab to flex towards the content cavity and towards the outer perimeter when the container is in a closed and locked position and wherein the pressure-activated anchor tab flexed toward the content cavity by the tab-activating post secures content received in the content cavity by preventing the shifting, sliding, or moving of the content in the content cavity and by preventing contact of the content with the cover portion.

2. The container of claim 1, wherein the tab-activating post further comprises an angled anchor tab activator.

3. The container of claim 2, wherein the tab-activating post further comprises a pressure ridge.

4. The container according to claim 1, wherein the tab-activating post is tapered.

5. The container according to claim 3, wherein the angled anchor tab activator and the pressure ridge are rounded.

6. The container according to claim 4, wherein the taper of the tapered tab-activating post narrows in a cover to base direction.

7. The container according to claim 1, further comprising an internal button locking assembly.

8. The container according to claim 1, wherein the pressure-activated anchor tab further comprises a hinged groove.

9. The container according to claim 8, wherein the container further comprises a buttress structure for the support of the hinged groove and anchor tab.

10. The container according to claim 1, further comprising contents positioned in the content cavity.

11. The container according to claim 1, wherein the content cavity further comprises an undercut retainer.

12. The container according to claim 1, further comprising a finger access channel.

13. The container according to claim 1, further comprising an external closing assembly.

14. The container according to claim 1, wherein the content cavity comprises one or more rigidity supports.

15. The container according to claim 14, wherein the number of content cavities is selected from the group consisting of two, four, six, eight, ten, twelve, fourteen, and sixteen content cavities.

16. The container according to claim 15, comprising two or more tab-activating posts.

17. The container according to claim 1, wherein the cover portion and the base portion are joined together by a hinge.

18. A method of improving the securing of contents within a container comprising the step of incorporating an enhanced content security mechanism of claim 1, such that the securing capability of the container is improved.

* * * * *